US012025337B2

(12) United States Patent
Fard

(10) Patent No.: US 12,025,337 B2
(45) Date of Patent: Jul. 2, 2024

(54) BAFFLE FOR DIRECTING REFRIGERANT LEAKS

(71) Applicant: Carrier Corporation, Palm Beach Gardens, FL (US)

(72) Inventor: Hafez Raeisi Fard, Indianapolis, IN (US)

( * ) Notice: Subject to any disclaimer, the term of this patent is extended or adjusted under 35 U.S.C. 154(b) by 239 days.

(21) Appl. No.: 17/249,812

(22) Filed: Mar. 15, 2021

(65) Prior Publication Data

US 2021/0293446 A1 Sep. 23, 2021

Related U.S. Application Data

(60) Provisional application No. 62/991,922, filed on Mar. 19, 2020.

(51) Int. Cl.
*F24F 13/20* (2006.01)
*F24F 11/36* (2018.01)

(52) U.S. Cl.
CPC ..... *F24F 13/20* (2013.01); *F24F 11/36* (2018.01)

(58) Field of Classification Search
CPC ..... F24F 13/20; F24F 11/36
USPC ..... 62/298
See application file for complete search history.

(56) References Cited

U.S. PATENT DOCUMENTS 2,210,031 A * 8/1940 Greene ..... F25D 31/003 165/145
4,072,183 A * 2/1978 Fraas ..... F22B 1/063 165/104.21
6,536,225 B1 * 3/2003 Yajima ..... F24F 1/022 62/407
6,968,706 B2 * 11/2005 Kadle ..... F25B 49/005 62/149
2012/0011867 A1 * 1/2012 Koons ..... F28D 1/0443 165/165
2012/0189523 A1 * 7/2012 Ohtsuka ..... B01J 23/468 422/111
2021/0033345 A1 * 2/2021 Kimmel ..... F28F 9/001
2021/0293446 A1 * 9/2021 Fard ..... F24F 13/20
2022/0205725 A1 * 6/2022 Taras ..... F25B 39/028

FOREIGN PATENT DOCUMENTS

KR 20080070140 A * 7/2008
WO WO-2020003664 A1 * 1/2020
WO WO-2021050618 A1 * 3/2021 ..... F24F 1/0059

* cited by examiner

*Primary Examiner* — Claire E Rojohn, III

(57) ABSTRACT

A heating, ventilation, and/or air conditioning (HVAC) system including a baffle disposed vertically adjacent to a heat exchanger, and a method for controlling the flow of a refrigerant leak are provided. The baffle may direct at least a portion of a refrigerant leak toward a refrigerant detection assembly. The refrigerant detection assembly may include a nondispersive infrared (NDIR) sensor. The baffle may include a fishbone configuration or a helical configuration. The baffle may direct substantially all of the refrigerant leak away from a control box, which may include at least one potential ignition source (e.g., an electrical component, such as a contactor). When the heating, ventilation, and/or air conditioning (HVAC) system utilizes a flammable refrigerant, the baffle may help mitigate potential ignition of the flammable refrigerant.

12 Claims, 5 Drawing Sheets

BAFFLE FOR DIRECTING REFRIGERANT LEAKS

CROSS REFERENCE TO A RELATED APPLICATION

The application claims the benefit of U.S. Provisional Application No. 62/991,922 filed May 19, 2020, the contents of which are hereby incorporated in their entirety.

BACKGROUND

Heating, ventilation, and/or air conditioning (HVAC) systems for residential or commercial buildings typically include an outdoor unit and an indoor unit. The indoor unit contains an indoor heat exchanger, which absorbs heat from the air being passed through the system using a refrigerant when the system is operating in cooling mode. The outdoor unit contains an outdoor heat exchanger, which cools and condenses the gaseous refrigerant when the system is operating in cooling mode. This refrigerant, historically, has been provided as a fluid with a high GWP value such as R134A or R410A. Although these refrigerants are effective coolants, the effect they can have on the environment has led to the institution of requirements that new refrigerants, which have moderate-to-low GWP values, be employed instead.

Moderate-to-low GWP refrigerants can be mildly flammable or flammable, (i.e. A2L and/or A3 refrigerants), however, and thus their use in HVAC systems can present risks that needs to be addressed. In particular, to the extent that refrigerant leaks are possible in HVAC systems, it may be desirable to both promptly detect any leak and/or separate any leak from any potential ignition sources. Potential ignition sources may include any component with an open electrical circuit that has enough energy to potentially ignite the refrigerant. One component of conventional HVAC systems that has a traditionally open electrical circuit is a contactor. These contactors are typically housed within the control box of an outdoor HVAC unit.

Potential solutions currently being considered to mitigate the potential ignition of A2L and/or A3 refrigerants include either (i) redesigning the ignition components (e.g., the contactors), and/or (ii) completely sealing the areas with ignition components (e.g., the control box). However, each of these potential solutions may significantly increase the cost of the unit, and may not aid in the detection of refrigerant leaks.

Accordingly, there remains a need to for a heating, ventilation, and/or air conditioning (HVAC) system with a more easily implementable solution that mitigates the potential ignition of A2L and/or A3 refrigerants while also aiding in the detection of refrigerant leaks.

BRIEF DESCRIPTION

According to one embodiment, a heating, ventilation, and/or air conditioning (HVAC) system including a heat exchanger and a baffle is provided. The heat exchanger can be used for transferring heat between a refrigerant and a fluid medium. The heat exchanger includes a lateral side. The baffle may be disposed vertically adjacent to the lateral side of the heat exchanger. The baffle is configured to direct at least a portion of a refrigerant leak.

In accordance with additional or alternative embodiments, the baffle is disposed within at least one of an outdoor unit and an indoor unit.

In accordance with additional or alternative embodiments, the baffle is disposed less than one (1) inch from the lateral side of the heat exchanger.

In accordance with additional or alternative embodiments, at least a portion of the refrigerant leak is directed downward by the baffle toward a refrigerant detection assembly.

In accordance with additional or alternative embodiments, the refrigerant detection assembly includes a nondispersive infrared sensor.

In accordance with additional or alternative embodiments, the refrigerant detection assembly is disposed adjacent to a distal end of the baffle.

In accordance with additional or alternative embodiments, the baffle has a fishbone configuration.

In accordance with additional or alternative embodiments, the baffle has a helical configuration.

In accordance with additional or alternative embodiments, the refrigerant includes at least one of an A2L refrigerant and an A3 refrigerant.

In accordance with additional or alternative embodiments, the A2L refrigerant is R454B.

In accordance with additional or alternative embodiments, the HVAC system further includes a control box disposed within at least one of the outdoor unit and the indoor unit, the control box including at least one electrical component for controlling the supply of an electrical power to the HVAC system.

In accordance with additional or alternative embodiments, the baffle directs substantially all of the refrigerant leak away from the control box.

According to another aspect of the disclosure, a method for controlling the flow of a refrigerant leak is provided. The method provides for the operating of a pump to circulate a refrigerant between an indoor heat exchanger and an outdoor heat exchanger, a baffle disposed vertically adjacent to at least one of: the indoor heat exchanger and the outdoor heat exchanger. The method also provides for the directing of at least a portion of a refrigerant leak, with the baffle, downward toward a refrigerant detection assembly.

In accordance with additional or alternative embodiments, the refrigerant detection assembly includes a nondispersive infrared sensor.

In accordance with additional or alternative embodiments, the method further includes the triggering of a response with the refrigerant detection assembly when the refrigerant detection assembly detects at least a 25% lower flammability limit.

In accordance with additional or alternative embodiments, the at least 25% lower flammability limit is reached by a leak of at least one of an A2L refrigerant and an A3 refrigerant.

In accordance with additional or alternative embodiments, the refrigerant detection assembly triggers the response within ten seconds of being exposed to 100% lower flammability limit.

In accordance with additional or alternative embodiments, the response includes at least one of: an alarm signal, stopping operation of the pump, opening a damper, and operating an indoor fan of the HVAC system.

BRIEF DESCRIPTION OF THE DRAWINGS

The subject matter, which is regarded as the disclosure, is particularly pointed out and distinctly claimed in the claims at the conclusion of the specification. The following descriptions of the drawings should not be considered limiting in any way. With reference to the accompanying drawings, like elements are numbered alike:

DETAILED DESCRIPTION

Figure 1:
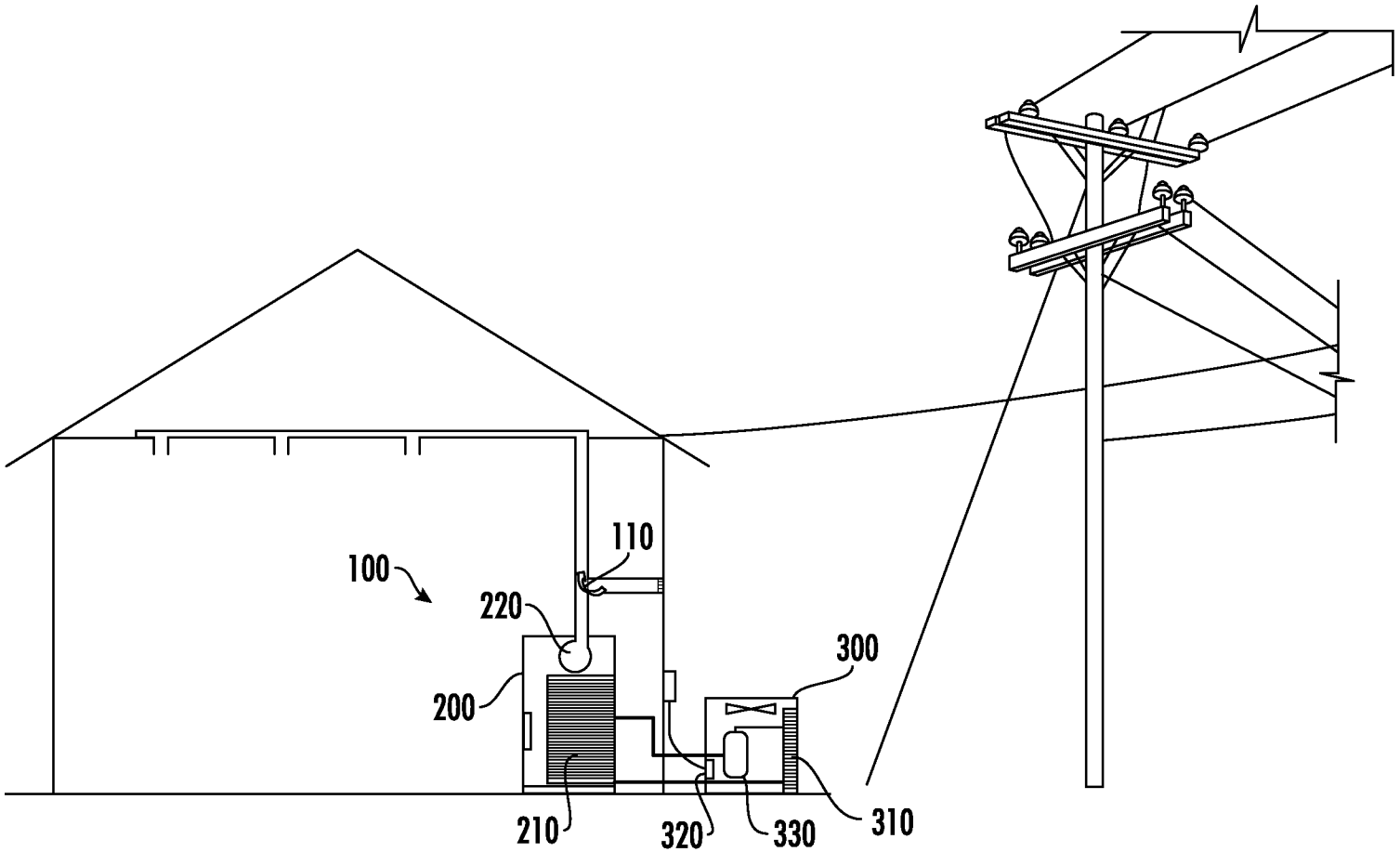
FIG. 1 is a schematic illustration of a heating, ventilation, and/or air conditioning (HVAC) system in accordance with one aspect of the disclosure.

As will be described below, a heating, ventilation, and/or air conditioning (HVAC) system including a baffle disposed vertically adjacent to a lateral side of a heat exchanger, and a method of controlling the flow of a refrigerant leak using the baffle are provided. The baffle may direct a refrigerant leak to a refrigerant detection assembly and/or away from a control box. Directing the refrigerant leak toward the refrigerant detection assembly may enable the refrigerant detection assembly to more quickly detect a refrigerant leak. The refrigerant detection assembly may utilize a nondispersive infrared (NDIR) sensor to detect refrigerant leaks. Directing the refrigerant leak away from the control box may help mitigate the potential ignition of the refrigerant. This may be because the control box may include at least one electrical component (e.g., a contactor), which may have an open electrical circuit that has enough energy to potentially ignite the refrigerant. The use of this baffle to control the flow of a refrigerant leak may be especially useful when a flammable refrigerant, such as an A2L refrigerant (e.g., R454B) and/or an A3 refrigerant, is used within the HVAC system.

The classification of refrigerant is based upon American Society of Heating, Refrigerating and Air-Conditioning (ASHRAE) Standard 34. The standard evaluates each refrigerant's flammability and toxicity and gives it a class referenced as a letter and number combination. The letter refers to the refrigerants toxicity, and is based on the particular refrigerant's occupational exposure limit (OEL). An "A" is given to refrigerants with a 400 ppm or greater OEL. A "B" is given to refrigerants with less than 400 ppm OEL. The number adjacent to the letter refers to the refrigerants flammability, and is based on the burning velocity (BV), heat of combustion (HOC), and lower flammability limits (LFL) of the particular refrigerant. A flammability of "1" is the lowest, with a "3" being the highest. Recently the second class was broken into "2L" and "2". A rating of "2L" indicates that while the refrigerant is still considered flammable, its flammability is much lower than that of class 2 or 3. It should be appreciated that the use of the baffle to direct refrigerant leaks may be useful in the detection and/or ignition mitigation of any flammable refrigerant (e.g., A2L, A2, and/or A3 refrigerants). Depending on the classification of the refrigerant however different mitigation strategies may be necessitated (e.g., additional measures may be needed for A2 and/or A3 refrigerants) due, at least in part, to the particular lower flammability limit (LFL) of the refrigerant being utilized.

A lower flammability limit (LFL) of a refrigerant is the minimum concentration limit that is required for the refrigerant to become potentially combustible. For example, R-32, which is an A2L refrigerant, has a LFL of 13.3%. A 25% LFL value is one quarter of the value of the LFL. For example, R-32 has a 25% LFL value of 3.3%. For illustrative purposes, if the R-32 were used as the refrigerant in the HVAC system, the refrigerant detection assembly may be configured to trigger a response when the refrigerant detection assembly detects at least 3.3% of R-32 in the sample. In certain instances, the refrigerant detection assembly may be capable of triggering a response within ten seconds of the refrigerant detection assembly being exposed to 100% LFL. For example, if using R-32 as the refrigerant, the refrigerant detection assembly may be capable of triggering a response within ten seconds of being exposed to 13.3% R-32.

With reference now to the Figures, a heating, ventilation, and/or air conditioning (HVAC) system 100 is schematically shown in FIG. 1. The HVAC system 100 may be provided for use within a building, such as a residential or commercial building, and may be configured as a ductless or ducted system. For purposes of clarity and brevity, however, the following description will relate to the exemplary use of the HVAC system 100 as a ducted system. The HVAC system 100 may include an indoor unit 200 and an outdoor unit 300. When operating in cooling mode, the indoor heat exchanger 210 absorbs heat from the air being passed through the HVAC system 100. The cooled air is then circulated into the building by way of the air ducts. The outdoor unit 300, in addition to including an outdoor heat exchanger 310, may also include a fan and a pump 330. When operating in cooling mode, the outdoor heat exchanger 310, in combination with the fan, operates to absorb heat from the refrigerant being passed through the outdoor unit 300. The pump in the outdoor unit 300 pumps the refrigerant in a cyclical manner through the HVAC system 100. This refrigerant may, in rare instances, leak into the HVAC system 100 (e.g., through one or more crack in a heat exchanger 210, 310). When utilizing a flammable refrigerant in the HVAC system 100, a leak of refrigerant could lead to undesirable consequences due to the flammable nature of the refrigerant.

As described above, both the outdoor heat exchanger 310 and the indoor heat exchanger 210 may be capable of transferring heat between a refrigerant and a fluid medium (e.g., transferring heat to or from air, water, etc.). To circulate air through the indoor unit 200 (e.g., to transfer heat between the air and the refrigerant in the indoor heat exchanger 210), the indoor unit 200 may include a fan 220. To control the supply of power (e.g., to the pump 330), the outdoor unit 300 may include an electrical component 320. As mentioned above, the electrical component 320 may contain enough energy to potentially ignite a flammable refrigerant (e.g., an A2L and/or A3 refrigerant). This may be especially possible when the electrical component 320 makes or breaks the circuit. For example, when the electrical component 320 either connects or disconnects power from the power grid to one or more load devices, such as, a pump 330. In certain instances, the electrical component 320 is housed within a control box 340. It should be appreciated that the outdoor unit 300 and the indoor unit 200 each may respectively have a control box 340, which may house at least one electrical component 320. To mitigate the potential ignition of refrigerant in the event of a refrigerant leak, the HVAC system 100 may be designed in such a way that if a refrigerant leak occurs, the refrigerant is directed away from the electrical component 320 and/or the control box 340. This directing of the refrigerant leak may be completed using a baffle 400 (shown in FIG. 2). This baffle 400 may be disposed vertically adjacent to the indoor heat exchanger 210 and/or the outdoor heat exchanger 310.

Figure 2:
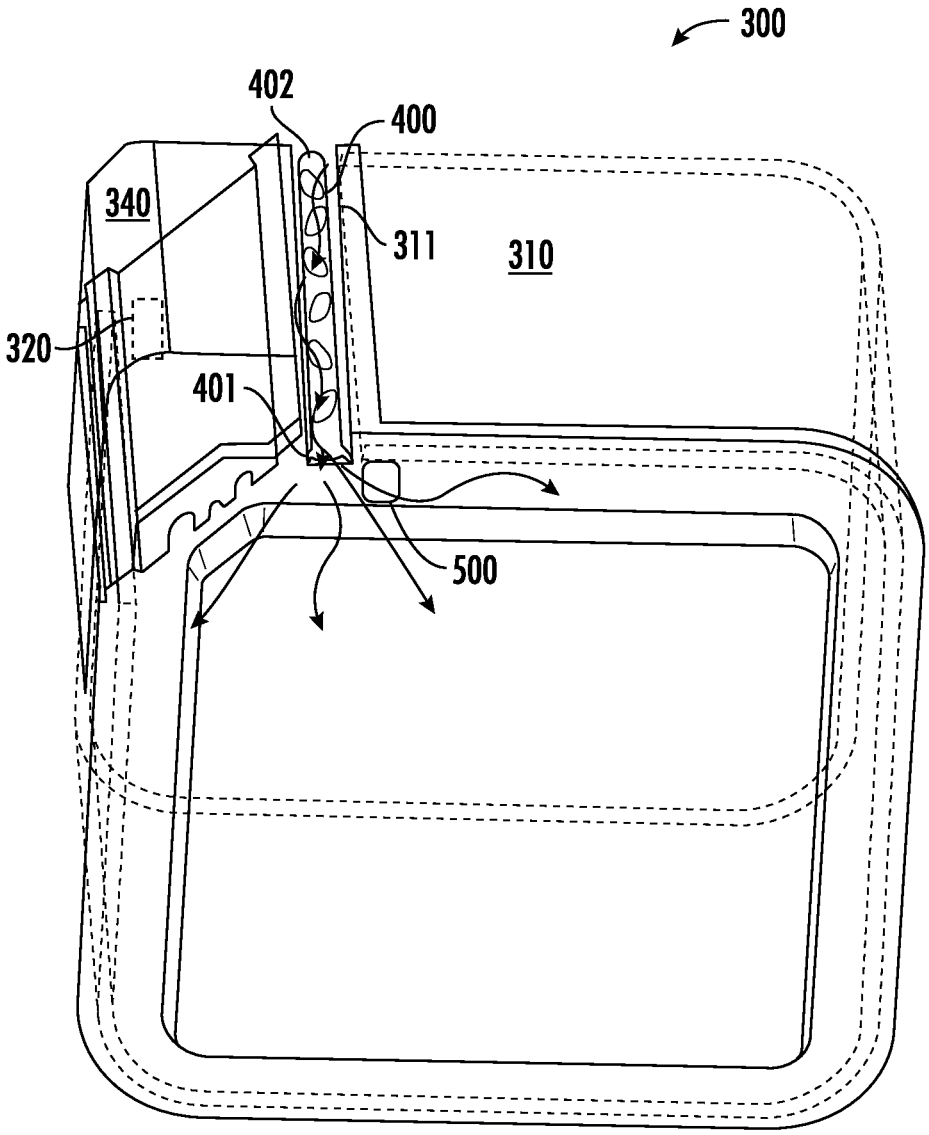
FIG. 2 is a perspective view of the outdoor unit, as shown in FIG. 1, with a baffle disposed vertically adjacent to the lateral side of the heat exchanger in accordance with one aspect of the disclosure.

FIG. 2 depicts the baffle 400 disposed vertically adjacent to the lateral side 311 of the outdoor heat exchanger 310. Vertically adjacent may be interpreted to mean that the baffle 400 is configured approximately perpendicular to the lower surface of the unit of which it is incorporated (e.g., the lower surface of the indoor unit 200 and/or lower surface of the outdoor unit 300). Being approximately perpendicular may mean that the baffle 400 and the lower surface of the unit form an angle of approximately 90° (e.g., +/−5°). It is envisioned that the baffle 400 may be disposed at any angle so long as the baffle 400 is capable of directing at least a portion of a refrigerant leak.

Figure 3:
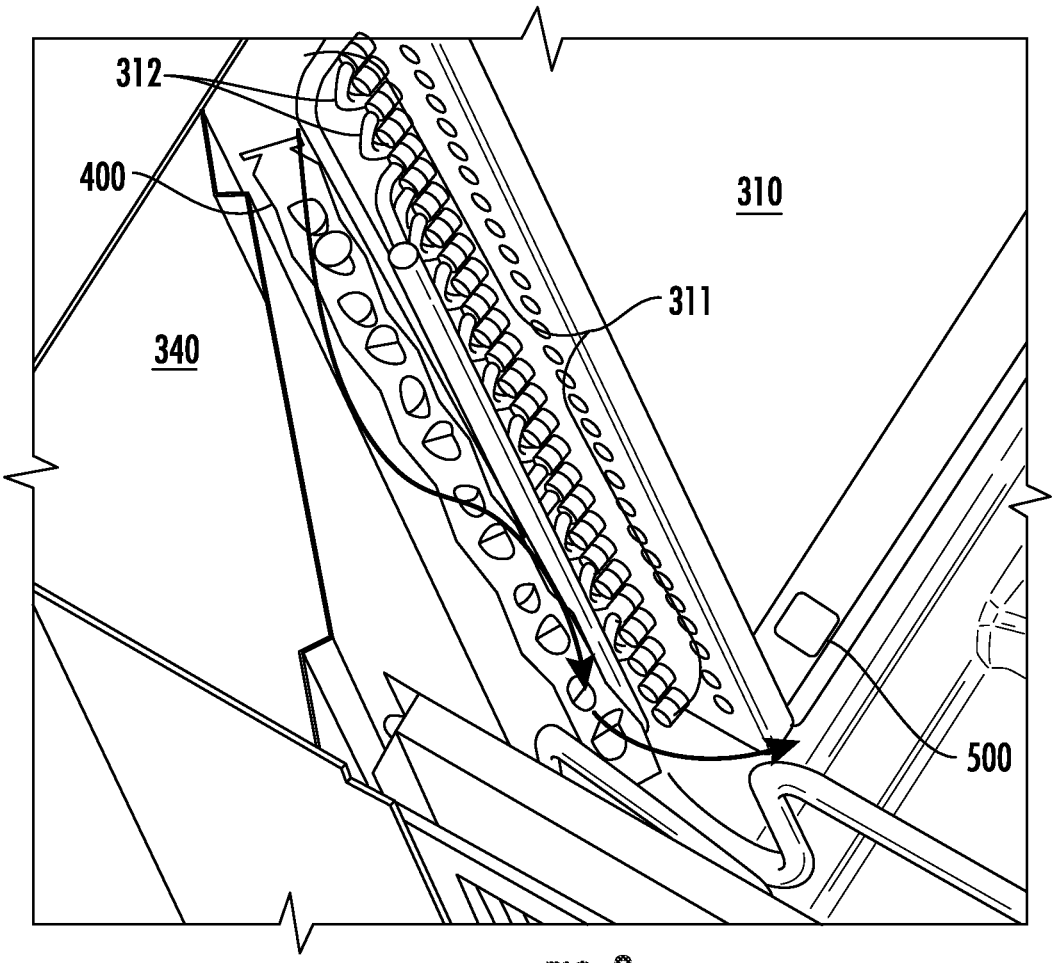
FIG. 3 is a perspective view of the heat exchanger, as shown in FIG. 2, with at least one bend along the lateral side in accordance with one aspect of the disclosure.

The lateral side 311 of the heat exchanger 310 is shown in FIG. 3. The lateral side 311 of the heat exchanger 310 may be interpreted to mean the location at which the heat exchanger 310 terminates. For example, when the heat exchanger 310 is made of one or more coil(s), the heat exchanger 310 may terminate where the coil stops and/or forms a bend 312. It being noted that both the indoor heat exchanger 210 and the outdoor heat exchanger 310 may include one or more lateral side(s) of which a baffle 400 may be disposed vertically adjacent to. In certain instances the baffle 400 is disposed less than one (1) inch from the lateral side 311 of the heat exchanger 310 so as to be capable of directing at least a portion of a refrigerant leak. It should be appreciated that the baffle 400 may be placed farther than one (1) inch from the lateral side 311 of the heat exchanger 310. Placing the baffle 400 vertically adjacent to the lateral side 311 (e.g., where a bend 311 in a coil may be found) may increase the ability of the baffle 400 to direct a refrigerant leak, as leaks may be more likely to occur along the lateral side 311 of the heat exchanger 310.

The placement of the baffle 400 vertically adjacent to the lateral side 311 of the heat exchanger 310 may enable the baffle 400 to direct at least a portion of a refrigerant leak downward (e.g., toward a refrigerant detection assembly 500). The refrigerant detection assembly 500 may be disposed adjacent to a distal end 401 of the baffle 400. The distal end 401 of the baffle 400 may be interpreted to be the end of the baffle 400 opposite of the proximal end 402 of the baffle 400. In certain instances, the distal end 401 of the baffle 400 is located near the lower surface of the unit of which the baffle 400 is incorporated. In certain instances, the refrigerant detection assembly 500 may be disposed on the lower surface of the unit of which it is incorporated (e.g., the lower surface of the indoor unit 200 and/or lower surface of the outdoor unit 300) and/or attached to the sheet metal of the unit of which it is incorporated (e.g., adjacent to the lateral side 311 of the heat exchanger 310).

When refrigerant leaks from a heat exchanger 310, the refrigerant exits the heat exchanger 310 (e.g., through a crack in the coil) at a high velocity (e.g., as a stream of liquid refrigerant) due to the refrigerant being under pressure. This pressure may be caused, at least in part, by the pump 330. The baffle 400, by being disposed vertically adjacent to the lateral side 311 of the heat exchanger 310, may stop the stream of refrigerant from shooting into the control box 340 (e.g., where the electrical component 320 may be) by coming into contact with the refrigerant. In certain instances, the baffle 400 stops substantially all of the refrigerant leak (e.g., keeping substantially all the refrigerant leak from entering the control box 340).

Figure 4:
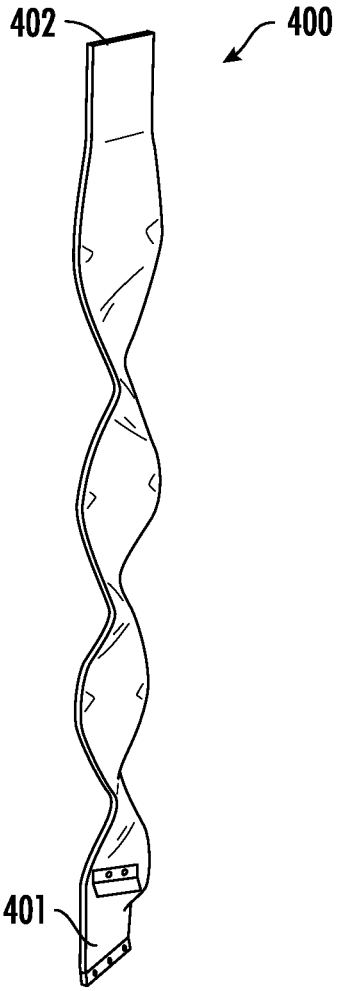
FIG. 4 is a perspective view of a first embodiment of a baffle in accordance with one aspect of the disclosure.
Figure 5:
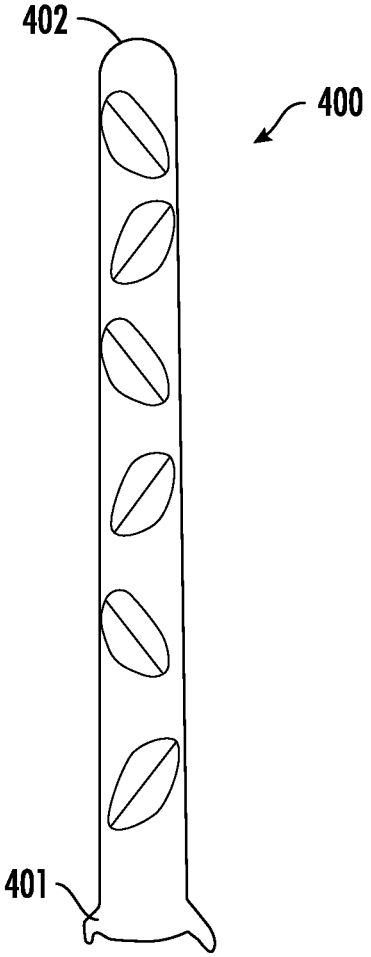
FIG. 5 is a perspective view of a second embodiment of a baffle in accordance with one aspect of the disclosure.

Once the refrigerant comes into contact with the baffle 400, the refrigerant may be directed downward, as shown in FIGS. 2 and 3. In certain instances, the baffle 400 directs the refrigerant downward due, at least in part, to the shape of the baffle 400. A first embodiment of a baffle 400 in a helical configuration is shown in FIG. 4. The helical configuration may be any configuration that has a surface that extends around a central axis (e.g., in a screw-like or spiral manner). In certain instances, the refrigerant, once coming into contact with the baffle 400, flows around the helical configuration downward toward a refrigerant detection assembly 500. A second embodiment of a baffle 400 in a fishbone configuration is shown in FIG. 5. The fishbone configuration may be any configuration that has a surface that causes a liquid to flow in a back and forth, downward manner. In certain instances, the fishbone configuration includes a series of holes and flaps to cause the refrigerant to flow in a back and forth, downward manner (e.g., from one flap to another all the way down the baffle 400). To get the refrigerant to flow from one flap to another, each flap may have an opposite slanting orientation relative to the above/below flap. In certain instances, the refrigerant, once coming into contact with the baffle 400, flows down the fishbone configuration toward a refrigerant detection assembly 500.

The refrigerant detection assembly 500 may include a nondispersive infrared (NDIR) sensor and a controller operatively connected to the nondispersive infrared sensor (e.g., using one or more wireless and/or wired connection) to receive output signals from the NDIR sensor and determine whether a response should be triggered. The controller may be configured to trigger a response when the refrigerant detection assembly 500 detects at least 25% lower flammability limit (LFL). In instances where the refrigerant detection assembly 500 detects a leak (ex. when the refrigerant detection assembly 500 detects at least 25% LFL) in the HVAC system 100, the response triggered by the controller may include at least one of: an alarm signal, stopping operation of the pump 330, opening a damper 110 (as shown in FIG. 1), and operating an indoor fan 220 of the HVAC system 100. The response may encourage the dilution of refrigerant in the building or HVAC system 100 by directing (e.g., using the damper 110) the air from the HVAC system 100 outside the building. In certain instances, the response includes both opening the damper 110 and operating the indoor fan 220 of the HVAC system 100 to direct the air from the HVAC system 100 outside the building. By utilizing a damper 110, the HVAC system 100 may be capable of redirecting air outside the building when potentially hazardous conditions are present.

As described above, the configuration of the HVAC system 100 may allow for refrigerant leaks to be controlled in a manner that both mitigates the potential ignition of the refrigerant (e.g., by directing leaking refrigerant away from the control box 340, which may contain one or more electrical component 320) while also aiding in the detection of refrigerant leaks (e.g., by directing leaking refrigerant toward a refrigerant detection assembly 500).

Figure 6:
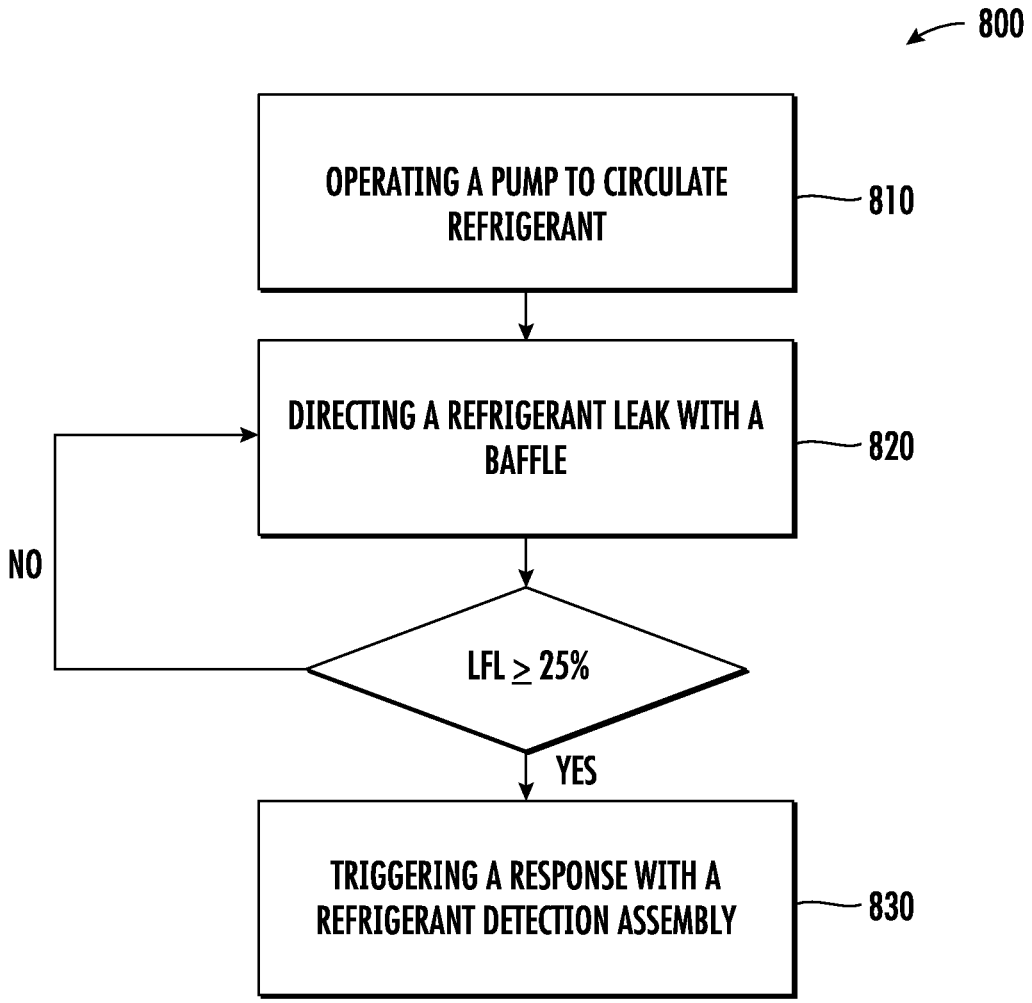
FIG. 6 is a flow diagram illustrating a method of controlling the flow of a refrigerant leak in accordance with one aspect of the disclosure.

The method 800 for controlling the flow of a refrigerant leak is illustrated in FIG. 6. This method 800 may be done, for example, using the exemplary HVAC system 100, as shown in FIGS. 1-5, which includes a baffle 400 disposed vertically adjacent to a lateral side 311 of a heat exchanger 310. As shown in FIG. 6, the method 800 includes step 810 of operating a pump 330 to circulate a refrigerant between an indoor heat exchanger 210 and an outdoor heat exchanger 310, a baffle 400 disposed vertically adjacent to at least one of the indoor heat exchanger 210 and the outdoor heat exchanger 310. The method 800 further includes step 820 of directing at least a portion of a refrigerant leak, with the baffle 400, downward toward a refrigerant detection assembly 500. The refrigerant detection assembly 500 may include a nondispersive infrared (NDIR) sensor capable of detecting refrigerant (e.g., an A2L refrigerant, such as R454B, and/or an A3 refrigerant). The method 800 may further include step 830 for triggering a response (e.g., with a controller of the refrigerant detection assembly 500) when the refrigerant detection assembly 500 detects at least a 25% lower flammability limit. The 25% lower flammability limit may be reached by a leak of at least one A2L and/or A3 refrigerant. In certain instances, the refrigerant detection assembly 500 triggers the response within ten (10) seconds of being exposed to 100% lower flammability limit. As described above, the response triggered by the refrigerant detection assembly 500 may include at least one of an alarm signal, stopping operation of the pump 330, opening a damper 110, and operating an indoor fan 220 of the HVAC system 100.

While the present disclosure has been described with reference to an exemplary embodiment or embodiments, it will be understood by those skilled in the art that various changes may be made and equivalents may be substituted for elements thereof without departing from the scope of the present disclosure. In addition, many modifications may be made to adapt a particular situation or material to the teachings of the present disclosure without departing from the essential scope thereof. Therefore, it is intended that the present disclosure not be limited to the particular embodiment disclosed as the best mode contemplated for carrying out this present disclosure, but that the present disclosure will include all embodiments falling within the scope of the claims.

What is claimed is:

1. A heating, ventilation, and/or air conditioning (HVAC) system comprising:

a heat exchanger for transferring heat between a refrigerant and a fluid medium, the heat exchanger comprising a lateral side, where a bend in the heat exchanger is located;

a control box, the control box comprising at least one electrical component for controlling the supply of an electric power to the HVAC system; and a baffle disposed vertically adjacent to the lateral side of the heat exchanger, vertically being defined from a lower surface of the HVAC system, the baffle configured to direct at least a portion of a refrigerant leak away from the control box.

2. The HVAC system of claim 1, wherein the baffle is disposed within at least one of an outdoor unit and an indoor unit.

3. The HVAC system of claim 1, wherein the baffle is disposed less than one (1) inch from the lateral side of the heat exchanger.

4. The HVAC system of claim 1, wherein at least a portion of the refrigerant leak is directed downward by the baffle toward a refrigerant detection assembly.

5. The HVAC system of claim 4, wherein the refrigerant detection assembly comprises a nondispersive infrared sensor.

6. The HVAC system of claim 4, wherein the refrigerant detection assembly is disposed adjacent to a distal end of the baffle.

7. The HVAC system of claim 1, wherein the baffle comprises a fishbone configuration.

8. The HVAC system of claim 1, wherein the baffle comprises a helical configuration.

9. The HVAC system of claim 1, wherein the refrigerant comprises at least one of an A2L refrigerant and an A3 refrigerant.

10. The HVAC system of claim 9, wherein the A2L refrigerant is R454B.

11. The HVAC system of claim 2, wherein the control box is disposed within at least one of the outdoor unit and the indoor unit.

12. The HVAC system of claim 1, wherein the baffle directs substantially all of the refrigerant leak away from the control box.

* * * * *